US009903305B2

(12) United States Patent
Mukaihara et al.

(10) Patent No.: US 9,903,305 B2
(45) Date of Patent: Feb. 27, 2018

(54) CONTROL DEVICE FOR INTERNAL COMBUSTION ENGINE

(71) Applicant: Hitachi Automotive Systems, Ltd., Hitachinaka-shi, Ibaraki (JP)

(72) Inventors: Osamu Mukaihara, Hitachinaka (JP); Masahiro Toyohara, Hitachinaka (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 341 days.

(21) Appl. No.: 14/409,610

(22) PCT Filed: Jun. 5, 2013

(86) PCT No.: PCT/JP2013/065529
§ 371 (c)(1),
(2) Date: Dec. 19, 2014

(87) PCT Pub. No.: WO2013/190995
PCT Pub. Date: Dec. 27, 2013

(65) Prior Publication Data

US 2015/0144109 A1 May 28, 2015

(30) Foreign Application Priority Data

Jun. 21, 2012 (JP) ..... 2012-139979

(51) Int. Cl.
*F02D 41/36* (2006.01)
*F02D 41/20* (2006.01)
(Continued)

(52) U.S. Cl.
CPC ..... *F02D 41/36* (2013.01); *F02D 41/20* (2013.01); *F02D 41/2467* (2013.01);
(Continued)

(58) Field of Classification Search
CPC ..... F02D 41/36; F02D 41/20; F02D 41/2467; F02D 2041/2031; F02D 2041/2034; F02D 2041/2058; F02M 51/00
(Continued)

(56) References Cited

U.S. PATENT DOCUMENTS 5,531,198 A * 7/1996 Matsuura ..... F02D 41/20 123/294
5,865,371 A * 2/1999 Pace ..... F02D 41/20 239/5
(Continued)

FOREIGN PATENT DOCUMENTS

CN 102192030 A 9/2011
EP 1 072 779 A2 1/2001
(Continued)

OTHER PUBLICATIONS

International Search Report (PCT/ISA/210) dated Jul. 16, 2013 with English-language translation.
(Continued)

*Primary Examiner* — Thomas Moulis
*Assistant Examiner* — John Bailey
(74) *Attorney, Agent, or Firm* — Crowell & Moring LLP

(57) ABSTRACT

A control device for an internal combustion engine is provided which can stabilize behavior when a fuel injection valve is opened, and reduce a variation in the amount of fuel injection of the fuel injection valve. A control device (200) for an internal combustion engine includes high voltage difference detection means (404) for obtaining a difference between a predetermined reference voltage (403) and a real high voltage detected by a high voltage detection means (402), drive current difference storage means (406) for storing in advance the amount of device difference variation of a real drive current detected by drive current detection
(Continued)

means (408), and drive control value correction means (409) for correcting at least one of a target value of a drive current to a fuel injection valve (105) and a target value of a drive time, on the basis of at least one result of the high voltage difference detection means and the drive current difference storage means, and corrects a target control value of the fuel injection valve on the basis of at least one detection result of the variation of the detected high voltage and the variation of the current for driving the fuel injection valve.

6 Claims, 8 Drawing Sheets

(51) Int. Cl.
*F02D 41/24* (2006.01)
*F02M 51/00* (2006.01)

(52) U.S. Cl.
CPC ..... *F02D 2041/2031* (2013.01); *F02D 2041/2034* (2013.01); *F02D 2041/2058* (2013.01); *F02M 51/00* (2013.01)

(58) Field of Classification Search
USPC ..... 123/490, 478, 472, 445; 239/5
See application file for complete search history.

(56) References Cited

U.S. PATENT DOCUMENTS 5,920,004 A * 7/1999 Gottshall ..... F02D 41/20 123/480
5,992,391 A * 11/1999 Yamakado ..... F02D 41/20 123/490
6,279,532 B1 * 8/2001 Takano ..... F02D 41/061 123/357
6,311,674 B1 * 11/2001 Igashira ..... F02D 41/3845 123/458
6,571,773 B1 * 6/2003 Yamakado ..... F02D 41/20 123/486
6,619,268 B2 * 9/2003 Rueger ..... F02D 41/2096 123/490
6,712,048 B2 * 3/2004 Aoki ..... F02D 41/20 123/490
8,018,216 B2 * 9/2011 Kakehi ..... F02D 41/20 323/266
8,081,498 B2 * 12/2011 Mayuzumi ..... F02D 41/20 123/490
8,514,541 B2 * 8/2013 Hatanaka ..... F02D 41/20 361/152
9,261,038 B2 * 2/2016 Nishida ..... F02D 41/20
9,322,354 B2 * 4/2016 Nishida ..... F02D 41/20
2002/0070721 A1 * 6/2002 Ostrom ..... G05F 1/56 323/284
2002/0189593 A1 * 12/2002 Yamakado ..... F02B 75/22 123/481
2004/0118384 A1 * 6/2004 Oyama ..... F02D 41/20 123/479
2004/0155121 A1 * 8/2004 Watanabe ..... F02D 41/20 239/533.2
2008/0083895 A1 * 4/2008 Ueda ..... F02D 41/20 251/129.15
2008/0184968 A1 * 8/2008 Matsuura ..... F02D 41/20 123/490
2009/0015223 A1 * 1/2009 Kakehi ..... F02D 41/20 323/282
2009/0107469 A1 * 4/2009 Takahashi ..... F02D 41/20 123/490
2010/0242920 A1 * 9/2010 Omori ..... F02D 41/20 123/490
2011/0100333 A1 * 5/2011 Toyohara ..... F02D 41/20 123/490
2011/0220067 A1 * 9/2011 Okonogi ..... F02D 41/20 123/480
2011/0222202 A1 * 9/2011 Onda ..... F02D 41/20 361/152
2012/0318883 A1 * 12/2012 Kusakabe ..... F02D 41/20 239/1
2014/0316679 A1 * 10/2014 Nishida ..... F02D 41/20 701/104

FOREIGN PATENT DOCUMENTS

EP 1 596 055 A1 11/2005
EP 1 953 372 A2 8/2008
EP 2 365 201 A2 9/2011
JP 10-266885 A 10/1998
JP 2002-514281 A 5/2002
JP 2003-148212 A 5/2003
JP 2008-190388 A 8/2008
JP 2009-138639 A 6/2009
JP 2011-52631 A 3/2011
JP 2011-94562 A 5/2011

OTHER PUBLICATIONS

European Office Action issued in counterpart European Application No. 13806394.6 dated May 15, 2017 (Eight (8) pages).
Chinese Office Action issued in counterpart Chinese Application No. 201380032563.2 dated Jun. 28, 2016 (Fourteen (14) pages) with English-language translation.
Extended European Search Report issued in counterpart European Application No. 13806394.6 dated Jan. 25, 2016 (Eight (8) pages).

* cited by examiner

CONTROL DEVICE FOR INTERNAL COMBUSTION ENGINE

TECHNICAL FIELD

The present invention relates to a control device for a cylinder direct-injection internal combustion engine, and for example, relates to a control device for driving a fuel injection valve.

Background Art

There has been known a conventional internal combustion engine control device where in one combustion cycle in the combustion chamber for an internal combustion engine, a fuel is injected from a fuel injection control device having a fuel injection valve electromagnetically driven to a combustion chamber at a given timing. Applications for a large number of techniques for stably controlling the behavior of a valve body equipped within the fuel injection valve have been filed. For example, there has been disclosed a technique for intermittently supplying a drive voltage so as to minimize an impulsive force when the valve body provided within the fuel injection valve is opened or closed (for example, refer to Patent Literature 1).

Incidentally, in the fuel injection control device for the cylinder direct-injection internal combustion engine, it is general that as a drive voltage of the fuel injection valve, a high voltage boosted to a given voltage on the basis of a battery voltage is applied to the fuel injection valve. This is intended to rapidly open a valve body of the fuel injection valve by applying a high voltage under a condition where the valve body equipped within the fuel injection valve is pushed in a valve closing direction with the aid of a high fuel pressure.

Also, in the technique of Patent Literature 1, there is disclosed that a voltage supply when driving the fuel injection valve is performed under time control. In the fuel injection control device for the cylinder direct-injection internal combustion engine, a drive current of a fuel injection valve is detected, and control is performed on the basis of the detected drive current.

CITATION LIST

Patent Literature 1: Japanese Translation of PCT International Application Publication No. 2002-514281

SUMMARY OF INVENTION

Technical Problem

However, because of a device difference variation in a circuit for boosting the battery voltage or a drive circuit for the fuel injection valve, a real drive current may be varied, or because of a variation in a circuit for detecting the drive current, a difference is likely to occur between a target drive current that is a control target and a real drive current that is detected by the control device.

Also, when a so-called multi-stage injection that plural injections are performed in one combustion cycle is performed, from a relationship of injection intervals of the cylinders (injection intervals between a first injection and a second injection, and between the second injection and a third injection), or injection timing of a present injection cylinder and a next injection cylinder, a possibility that the next injection is performed in a state where overall injection intervals are adjacent to each other, and the high voltage applied from the booster circuit does not reach a target high voltage is high. This leads to a risk that a variation in the fuel injection amount occurs because the valve body behavior of the fuel injection valve is different each time.

The present invention has been made in view of the above problems, and an object of the present invention is to provide a control device for an internal combustion engine which is capable of stabilizing the behavior when opening a fuel injection valve which is attributable to a variation in a device difference such as a drive circuit for the fuel injection valve, and reducing a variation in the fuel injection amount.

Solution to Problem

In order to achieve the above object, according to the present invention, there is provided a control device for an internal combustion engine, including a battery that applies a battery voltage to the internal combustion engine; a fuel injection valve that injects a fuel directly into a combustion chamber; high voltage generation means for boosting the battery voltage to a target high voltage to generate a desired high voltage; high voltage detection means for detecting a real high voltage generated by the high voltage generation means; fuel injection valve drive means for applying any one of the real high voltage detected by the high voltage detection means, and the battery voltage to the fuel injection valve at a desired timing to drive the fuel injection valve; and drive current detection means for detecting a drive current of the fuel injection valve, in which the control device includes high voltage difference detection means for obtaining a difference between a predetermined reference voltage and the real high voltage detected by the high voltage detection means, drive current difference storage means for storing the amount of device difference variation of the real drive current detected by the drive current detection means in advance, and drive control value correction means for correcting at least one of a target value of the drive current to the fuel injection valve and a target value of a drive time, on the basis of at least one result of the drive current difference storage means.

Advantageous Effects of Invention

According to the present invention, even if the device difference variation of the circuit that drives the fuel injection valve occurs or the variation occurs in the high voltage to be applied to the fuel injection valve, the behavior of the valve body equipped in the fuel injection valve can be stably controlled, and the variation in the fuel injection amount of the fuel injection valve can be reduced.

DESCRIPTION OF EMBODIMENTS

Figure 1:
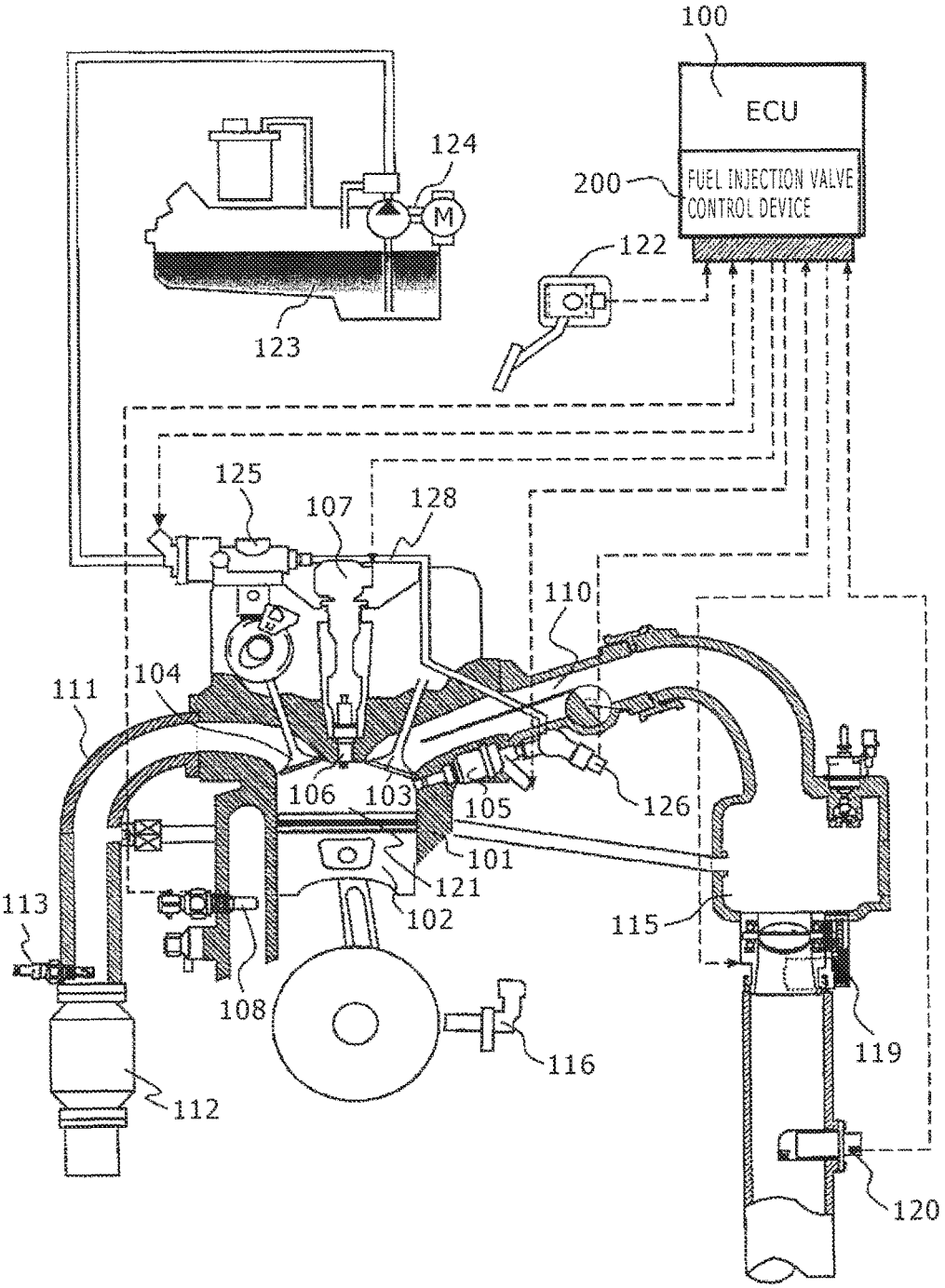
FIG. 1 is an overall configuration diagram of an internal combustion engine system using a control device for an internal combustion engine.

Hereinafter, a description will be given of a fuel injection control device for an internal combustion engine according to an embodiment of the present invention. FIG. 1 illustrates a basic configuration of an internal combustion engine and a fuel injection control device for the internal combustion engine according to this embodiment.

Referring to FIG. 1, an air to be sucked into an internal combustion engine 101 passes through an air flow meter (ARM: Air flow meter) 120, is sucked into a throttle valve 119 and a collector 115 in the stated order, and thereafter supplied to a combustion chamber 121 formed in an upper portion of a piston 102 through an intake pipe 110 and an intake valve 103 provided in each of cylinders.

On the other hand, a fuel is fed to a high pressure fuel pump 125 provided in the internal combustion engine 101 from a fuel tank 123 by the aid of a low pressure fuel pump 124, and the high pressure fuel pump 125 regulates a fuel pressure to a desired pressure on the basis of a control command value from an ECU (engine control unit) 100. As a result, the high pressure fuel is fed to a fuel injection valve 105 through a high pressure fuel pipe 128, and the fuel injection valve 105 injects the fuel into the combustion chamber 121 on the basis of a command from a fuel injection valve control device 200 provided in the ECU 100.

In order to control the high pressure fuel pump 125, the internal combustion engine 101 is equipped with a fuel pressure sensor 126 that measures a pressure within a high pressure fuel pipe 128. The ECU 100 generally performs so-called feedback control on the basis of the sensor value so that the fuel pressure within the high pressure fuel pipe 128 becomes a desired pressure. Further, the internal combustion engine 101 includes an ignition coil 107 and an ignition plug 106, and is structured so that an energization control to the ignition coil 107 and an ignition control by the ignition plug 106 are conducted at a desired timing by the ECU 100.

With the above configuration, the intake air and fuel are combusted by spark emitted from the ignition plug 106, and move down the piston 102 within the cylinder. An exhaust gas generated by the combustion is exhausted into an exhaust pipe 111 through an exhaust valve 104, and a three-way catalyst 112 for purifying the exhaust gas is disposed on the exhaust pipe 111.

The ECU 100 incorporates the fuel injection valve control 200 described above, and receives signals from a crank angle sensor 116 that measures a crank shaft (not shown) angle of the internal combustion engine 101, the AFM 120 indicative of the amount of intake air, an oxygen sensor 113 that detects an oxygen concentration in the exhaust gas, an accelerator opening sensor 122 indicative of the opening of an accelerator operated by a driver, and the fuel pressure sensor 126.

The signals input from the respective sensors will be further described. The ECU 100 calculates a required torque of the internal combustion engine 101, and also determines whether to be in an idle state, or not, according to the signal from the accelerator opening sensor 122. Also, the ECU 100 is equipped with rotational speed detection means for calculating a rotational speed (hereinafter referred to as "engine rotational speed") of the internal combustion engine according to the signal from the crank angle sensor 116, and means for determining whether the three-way catalyst 112 is in a warm-up state, or not, according to a cooling temperature of the internal combustion engine 101 which is obtained from a water temperature sensor 108, and an elapsed time after the internal combustion engine starts.

Also, the ECU 100 calculates the amount of intake air necessary for the internal combustion engine 101, and outputs an opening signal commensurate with the amount of intake air to the throttle valve 119. The fuel injection valve control device 200 calculates the amount of fuel corresponding to the amount of intake air, outputs a fuel injection signal to the fuel injection valve 105, and outputs an ignition signal to the ignition coil 107.

Figure 2:
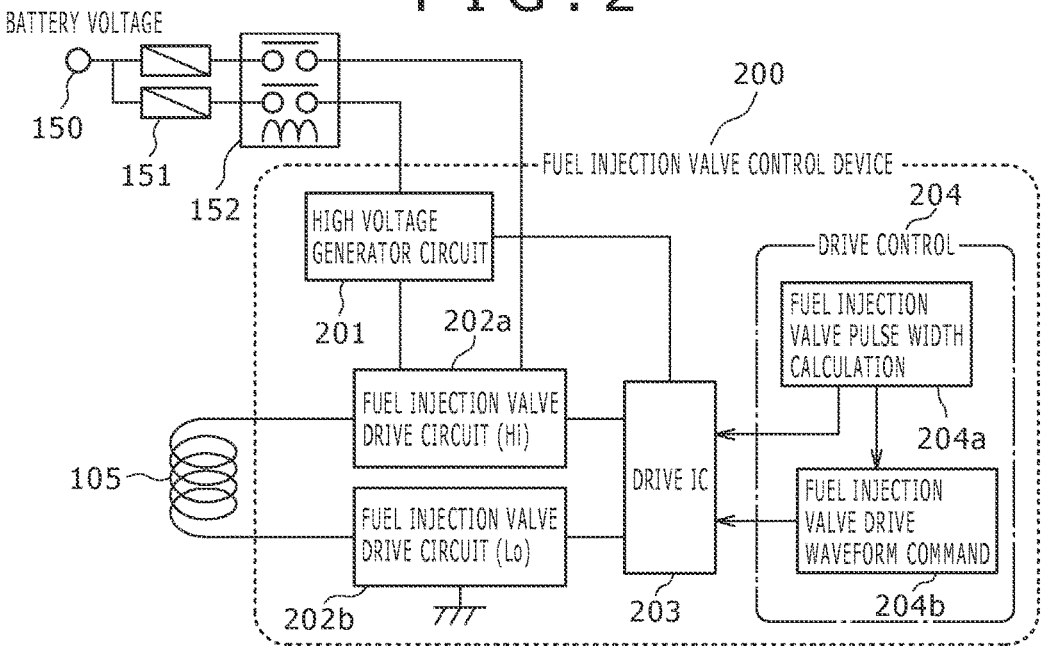
FIG. 2 is a configuration diagram of a fuel injection valve control device in FIG. 1.

FIG. 2 illustrates one example of a basic configuration of the fuel injection valve control device according to the present invention. In this figure, a voltage 150 (hereinafter referred to as "low voltage") applied from the battery is applied to the fuel injection valve control device 200 through a fuse 151 and a relay 152.

The fuel injection valve control device 200 will be described. A high voltage generator circuit 201 is a circuit that generates a high supply voltage (hereinafter referred to as "high voltage") necessary when a valve body provided within the fuel injection valve 105 opens on the basis of the low voltage applied from a battery (not shown), and the high voltage is boosted to a desired voltage on the basis of a command from a drive IC 203. Also, a fuel injection valve drive circuit (Hi) 202*a* is configured to select any one of the high voltage and the low voltage as the supply voltage to be applied to the fuel injection valve 105.

When the fuel injection valve 105 is opened from a closed state, the high voltage is first applied to the fuel injection valve 105, and after a valve opening current required when the valve body provided within the fuel injection valve opens is supplied thereto, the voltage to be applied is switched to the low voltage, and a holding current is supplied thereto in order to maintain the valve body within the fuel injection valve 105 in an valve opening state. A fuel injection valve drive circuit (Lo) 202*b* is a drive circuit disposed downstream of the fuel injection valve 105 in order to supply a drive current to the fuel injection valve 105 as with the fuel injection valve drive circuit (Hi) 202*a*.

The high voltage generator circuit 201, the fuel injection valve drive circuit (Hi) 202*a*, and the fuel injection valve drive circuit (Lo) 202*b* are controlled by the drive IC 203, and applies/supplies a desired drive voltage and drive current to the fuel injection valve 105. Also, a drive period (energization time of the fuel injection valve 105), a drive voltage value, and a drive current of the drive IC 203 are controlled on the basis of command values calculated by a fuel injection valve pulse width calculation block 204*a* and a fuel injection valve drive waveform command block 204*b* provided in a drive control block 204 within the fuel injection valve control device 200. With the above operation, the drive control and the amount of fuel injection of the fuel injection valve 105, which are necessary for combustion of the internal combustion engine 101, are optimally controlled.

Figure 3:
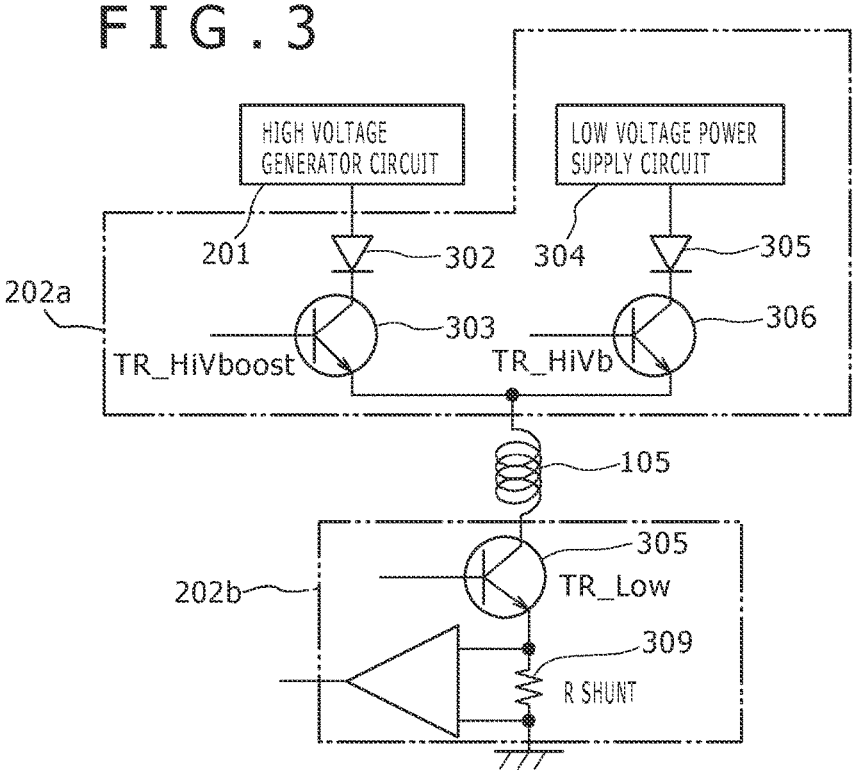
FIG. 3 is a configuration diagram of fuel injection valve drive means in FIG. 2.

FIG. 3 illustrates one example of the drive circuit of the fuel injection valve illustrated in FIG. 2. As described in FIG. 2, the fuel injection valve drive circuit (Hi) 202*a* that supplies the drive current in order to hold the opening and closing states of the fuel injection valve 105 is disposed upstream of the fuel injection valve 105. A current is applied to the fuel injection valve 105 from the high voltage generator circuit 201 in the figure through a diode 302 provided for the purpose of preventing a reverse current flow with the use of a TR_Hivboost 303 with the high voltage. On the other hand, after the fuel injection valve has been opened, power is supplied to the fuel injection valve 105 from a low voltage power supply circuit 304 for allowing a low current (the holding current) necessary to maintain (hold) a fuel injection valve open state to flow through a diode 305 for preventing the reverse current flow with the use of a circuit of a TR_Hivb 306 in the figure, as with the high voltage.

Subsequently, the above-described fuel injection valve drive circuit (Lo) 202*b* is disposed downstream of the fuel injection valve 105, and when a drive circuit TR_Low 308 turns on, a current supplied from the upstream high voltage generator circuit 201 or the low voltage power supply circuit 304 can be supplied to the fuel injection valve 105. Also, a current consumed by the fuel injection valve 105 is detected by a shunt resistor 309 disposed downstream of the fuel injection valve 105 to perform a desired fuel injection valve current control which will be described later.

Figure 4:
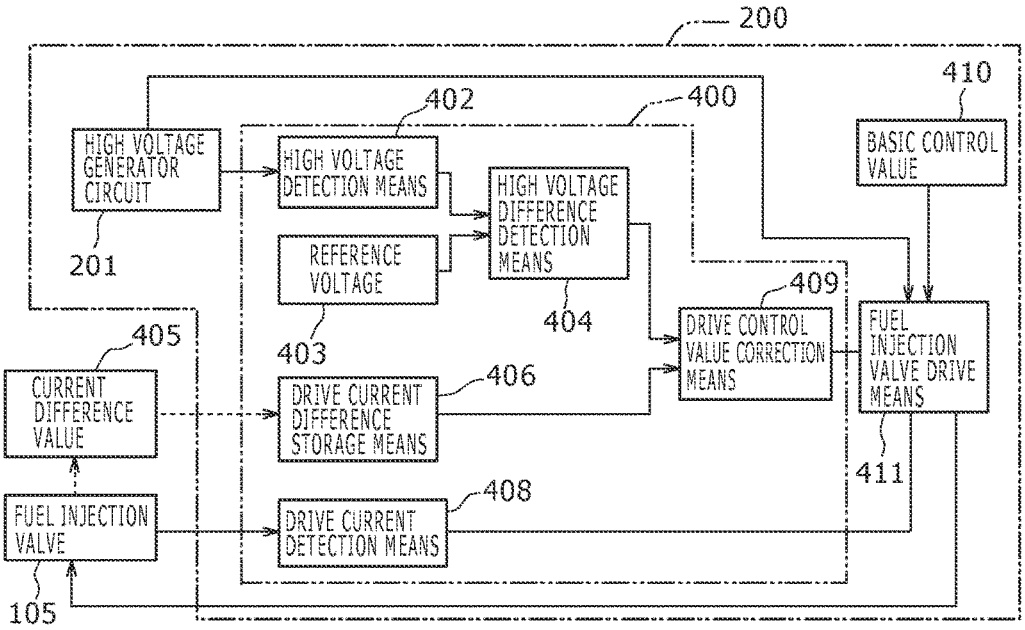
FIG. 4 is a block diagram illustrating a configuration of a control unit in FIG. 2.

FIG. 4 illustrates an example of a block diagram of a control unit 400 that corrects a drive control value (drive current or drive time) of the fuel injection valve 105 according to the present invention. Referring to FIG. 4, a high voltage generated by the high voltage generator circuit 201 is applied to fuel injection valve drive means 411, which means that a high voltage is applied to the drive IC 203 from the high voltage generator circuit 201 in FIG. 2. High voltage detection means 402 is provided for the purpose of detecting the high voltage generated by the high voltage generator circuit 201. High voltage difference detection means 404 calculates a difference between the real high voltage detected by the high voltage detection means 402, and a reference voltage 403 which will be described later, and delivers the difference to drive control value correction means 409.

On the other hand, since a variation in the drive current to be supplied to the fuel injection valve 105 is a device difference variation caused by components configuring the fuel injection valve control device 200, the drive current variation cannot be detected directly within the control unit 400. For that reason, the amount of device difference variation of the fuel injection valve control device 200 is detected as a current difference value 405, and stored in drive current difference storage means 406 in advance (indicated by a dashed line). The drive control value correction means 409 calculates the amount of correction of a target control value (target drive current or a target drive time) on the basis of a detection result of the high voltage difference detection means 404, and a current difference value recorded in the drive current difference storage means 406, and delivers the amount of correction to the fuel injection valve drive means 411. It is needless to say that because the current difference value 405 is detected as plus or minus with respect to the reference current value, the drive control value correction means 409 performs a correction of an increase/decrease corresponding to the plus or minus.

The fuel injection valve drive means 411 performs a control so that a drive current to the fuel injection valve 105 becomes a desired profile on the basis of a basic control value 410 calculated by the drive control block (204 in FIG. 2), and a drive current value of drive current detection means 403 for detecting a drive current of de fuel injection valve 105. When information from the drive control value correction means 409 is updated, the fuel injection valve drive means 411 reflects the information on a basic control value 410, and drives the fuel injection valve 105. The drive current detection means 408 is generally performed by a method using the shunt resistor 309 in FIG. 3.

Figure 5:
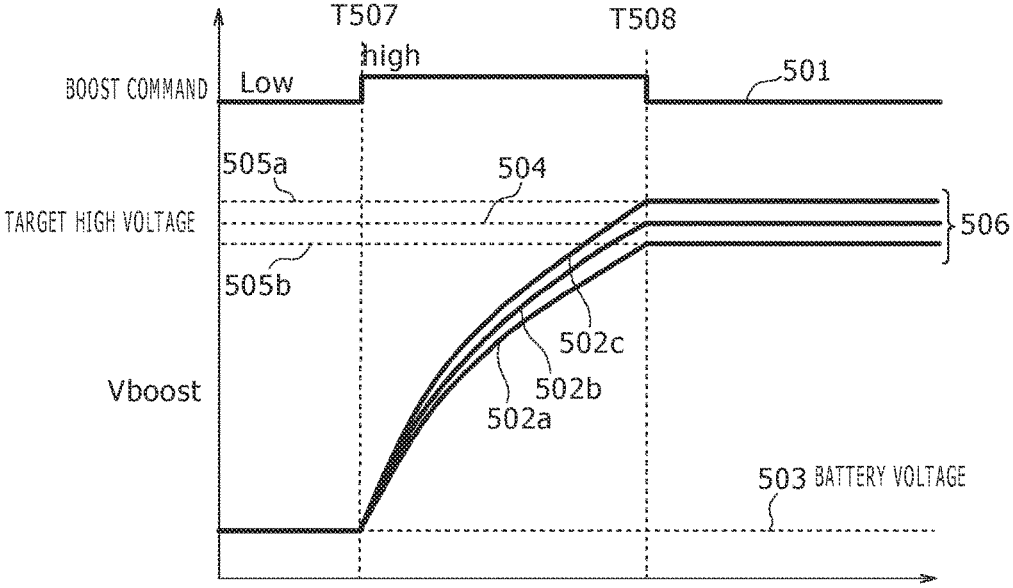
FIG. 5 is a timing chart 1 illustrating one example of a method for correcting high voltage generation means.

Subsequently, the high voltage difference detection means 404 within the control unit 400 in FIG. 4 will be described in detail with reference to FIGS. 5 and 6. FIG. 5 illustrates the characteristic when the high voltage generator circuit 201 boosts a battery voltage to a desired target voltage 504.

The high voltage generator circuit 201 boosts a battery voltage 503 to the target high voltage 504 on the basis of a boost command 501 from the drive IC 203. In the figure, the boost command starts the boost from a time T507 when the boost command changes from low to high. In association with this operation, boosted voltages (502*a*, 502*b*, 502*c*) are gradually boosted to the target high voltages 504. However, because the boost characteristics of the high voltage generator circuit 201 are varied, boosted voltage behaviors (502*a*, 502*b*, 502*c*) are boosted in respective different manners. Further, because the voltage value at a time T508 when the boosting operation stops falls within a given range 506 sandwiching the target high voltage 504 from the device difference variation of the high voltage generator circuit 201, the real high voltage has an upper limit value (505*a*) and a lower limit value (505*b*) with respect to the target high voltage 504. For that reason, the high voltage difference detection means (404 in FIG. 4) sets, for example, the target high voltage 504 as a reference voltage (403 in FIG. 4), and detects a difference between the target high voltage 504, and the real high voltages (502*a*, 502*b*, 502*c* subsequent to T508) detected by the high voltage detection means (402 in FIG. 4)

Also, when the above-mentioned multi-stage injection is conducted, it is assumed that the high voltage (hereinafter referred to as "Vboost") generated by the high voltage generator circuit (201 in FIG. 4) is supplied to the fuel injection valve from a state in which the voltage is remarkably lower than the target high voltage. The details will be described with reference to FIG. 6.

Figure 6:
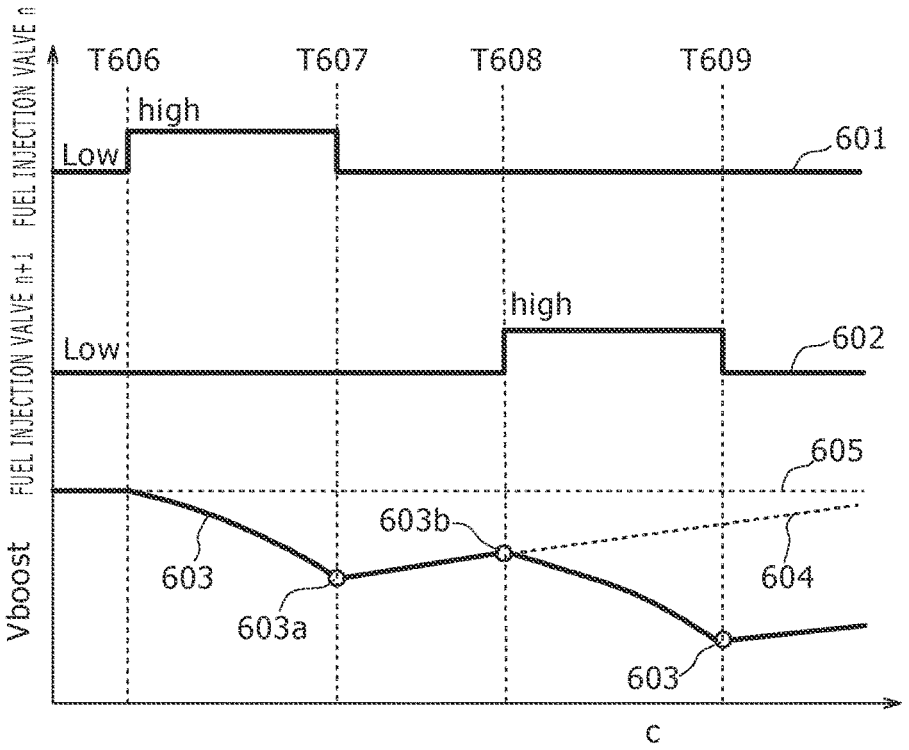
FIG. 6 is a timing chart 2 illustrating another example of the method for correcting the high voltage generation means.

FIG. 6 illustrates one example of the Vboost behavior under a multi-stage injection control. Referring to FIG. 6, a Vboost supply command signal 601 to the fuel injection valve n changes from low to high in a period from T606 to T607, and during this period, a Vboost 603 is supplied to the fuel injection valve n. For that reason, The Vboost 603 is reduced to 603*a*, and thereafter again boosted to a target high voltage 605 by a series of boost operation illustrated in FIG. 5. In the figure, the boosting behavior is illustrated with the inclusion of a dashed line from 603*a* to 604.

In the conventional injection control that does not perform the multi-stage injection, it is assumed that the Vboost 603 is not reduced during the boosting operation. However, when the multi-stage injection is performed, because the above-mentioned injection interval becomes shorter, the Vboost 603 is not always limited to the vicinity of the target high voltage 605.

For example, as illustrated in the figure, if the Vboost supply command signal 602 to the fuel injection valve N+1 is high from T608 to T609, the Vboost 603 is supplied to the fuel injection valve n+1 from the Vboost 603*b* at a time T608 during the boosting operation, and is reduced to Vboost 603*c* at a time T609. In the series of operation, there arises such a problem that the Vboost 603 to be supplied to the fuel injection valve n+1 becomes 603*b* remarkably apart from the target high voltage 605.

For that reason, the high voltage difference detection means 404 in FIG. 4 sets a reference boost characteristic 604 of the high voltage generator circuit (201 in FIG. 4) in advance, and predicts, for example, a voltage value 603*a* at a time T607 when the supply of the Vboost 603 to the fuel injection valve n stops, and a voltage 603*b* at a time T608 when the Vboost 603 starts to be supplied to the fuel injection valve n+1 on the basis of an elapsed time from T607 to T608, and the reference boost characteristic. Then, the high voltage difference detection means 404 corrects a variation of Vboost 603. As an example of the predicting method, there is a method in which a relational expression is used assuming that 603*a* is an intercept, and the reference boost characteristic is an inclination.

Figure 7:
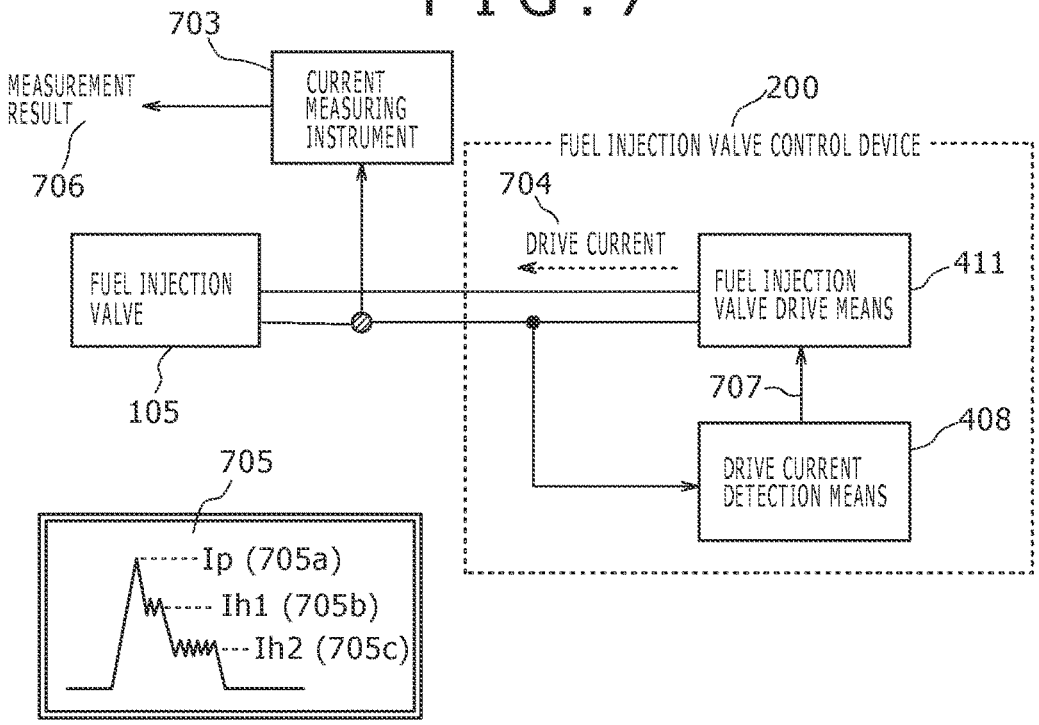
FIG. 7 is a block diagram illustrating an example of a drive current correcting method.

Subsequently, the drive current difference storage means 406 in FIG. 4 will be described with reference to FIGS. 7 and 8. FIG. 7 illustrates an example for detecting the drive current variation of the fuel injection valve. Referring to FIG. 7, the fuel injection valve control device 200 includes the fuel injection valve drive means 411 and the drive current detection means 408 which have been described above, and the fuel injection valve drive means 411 supplies a drive current 704 on the basis of plural target control values (705*a*, 705*b*, 705*c*) illustrated in reference numeral 705, and a real drive current 707 detected by the drive current detection means 408. Supplementally, the control system shows not a specific configuration, but an original drive configuration. Also, apart from the above control system, a current measuring instrument 703 that detects the drive current 704 to the fuel injection valve 105 is connected in a manner illustrated in the figure, and a current value detected by the current measuring instrument 703 becomes a measurement result 706.

This is a method in which in the original control system, the drive current 704 is switched and controlled depending on whether the drive current 707 detected by the drive current detection means 408 reaches the target control values (705*a*, 705*b*, 705*c*), or not. Because a variation in the real drive current 707 generated from the device difference variation such as the drive current detection means 408 cannot be grasped by the control system, all of the manufactured fuel injection valve control devices are measured independently. In this measurement, the device difference variation of the fuel injection valve control device 200 including the drive current detection means 408 is detected by the current measuring instrument 703 which is independent from the control system, and always stabilizes a measurement precision.

Figure 8:
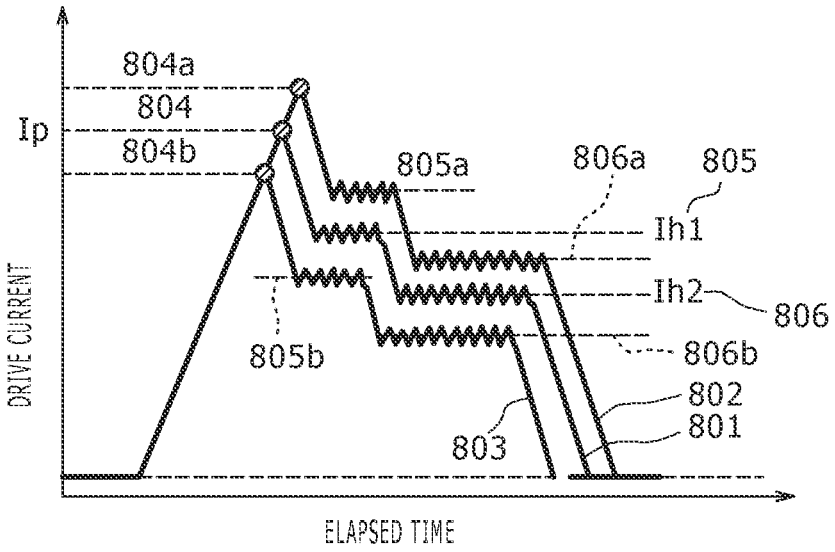
FIG. 8 is a timing chart of an example of the drive current correcting method.

The result measured by the above method is illustrated in FIG. 8. FIG. 8 is a diagram schematically illustrating a result 706 measured by the method illustrated in FIG. 7. Also, in the figure, the results measured by the different fuel injection valve control devices 200 are illustrated in three typical forms as 801, 802, and 803, respectively.

First, the measurement results of 801 are control led without any error, for the respective target control values that change as Ip (804), Ih1 (805), and Ih2 (806). This means that because the drive current detection means 408 in FIG. 7 has a standard characteristic, no correction is required. In other words, the fuel injection valve of reference numeral 801 has a characteristic having no error.

On the other hand, the respective measurement results of reference numeral 802 are represented by 804*a*, 805*a*, and 806*a*, and currents higher than the respective target control values 804, 805, and 806 are obtained. This means that the current value detected by the drive current detection means 408 having the measurement results of reference numeral 802 is dispersed at a higher side. Also, the respective measurement results of reference numeral 803 are represented by 804*b*, 805*b*, and 806*b*, and currents lower than the respective target control values 804, 805, and 806 are obtained, and the current values are dispersed at a lower side.

From the above results, there is a risk that the drive currents 801, 802, and 803 to the fuel injection valve 105 have different profiles from the device difference variation of the drive current detection means 408 in FIG. 70, and the behavior of the fuel injection valve 105 is dispersed. For that reason, in the present invention, the drive current variation is measured for each of the fuel injection valve control devices 200 (specifically, ECUs 100), and stored in the respective ECUs 100 to correct the drive current variation.

Figure 9:
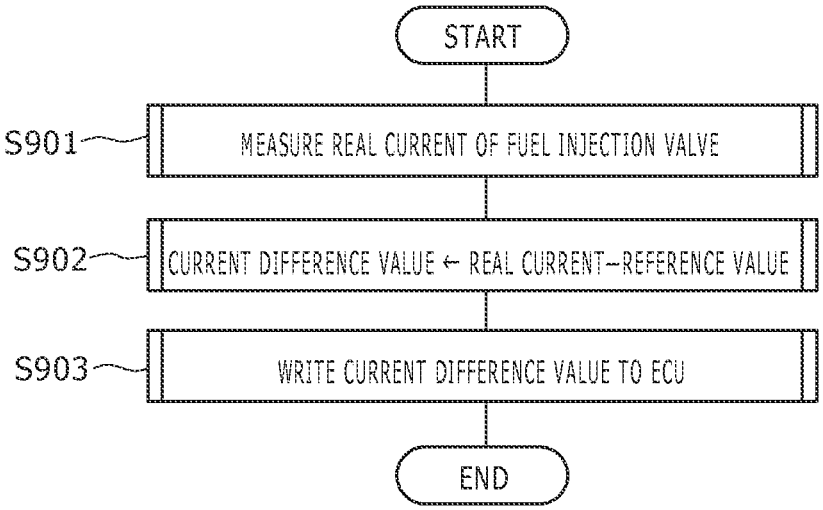
FIG. 9 is a flowchart of the drive current correcting method.

In detail, for example, differences between the original Ip (804) and the measurement results (804*a*, 804*b*) are measured in advance, through a procedure illustrated in FIG. 9. That is, the real drive current of the fuel injection valve 105 is measured (S901), current difference values between the target control value Ip (403) as a reference value, and the measured real drive current values (804*a*, 804*b*) are calculated (S902), and the results are written in the drive current difference storage means 406 (S903). The fuel injection valve control device 200 corrects a target control value 804 of the fuel injection valve 105 on the basis of the current difference values written into the drive current difference storage means 406.

Specifically, if the measurement result is higher than the reference value 804, that is, in the ECU 100 where the measurement result is represented by reference numeral 804*a*, the target current 804 of Ip is corrected to be lower by a difference therebetween. On the contrary, if the measurement result is lower than the reference value 804, that is, in the ECU 100 where the measurement result is represented by reference numeral 804*b*, the target current 804 of Ip is corrected to be higher by a difference therebetween. The target drive currents of Ih1 (805) and Ih2 (806) are subjected to the same procedure, thereby being capable of correcting the variation in the drive current. That is, the drive control value correction means 409 includes the current difference values set in the drive current difference storage means 406 in advance, and if the current difference value is higher than the reference voltage 403, a target value of the drive current to the fuel injection valve 105 is corrected to be lower by a current difference value set in the drive current difference storage means 406 in advance. Alternatively, the target value of the drive time is corrected to be shorter. Also, if the current difference value set in the drive current difference storage means 406 in advance is lower than the reference voltage 403, the target value of the drive current to the fuel injection valve 105 is corrected to be higher by the current difference value set in the drive current difference storage means 406 in advance, or the target value of the drive time is corrected to be longer.

Figure 10:
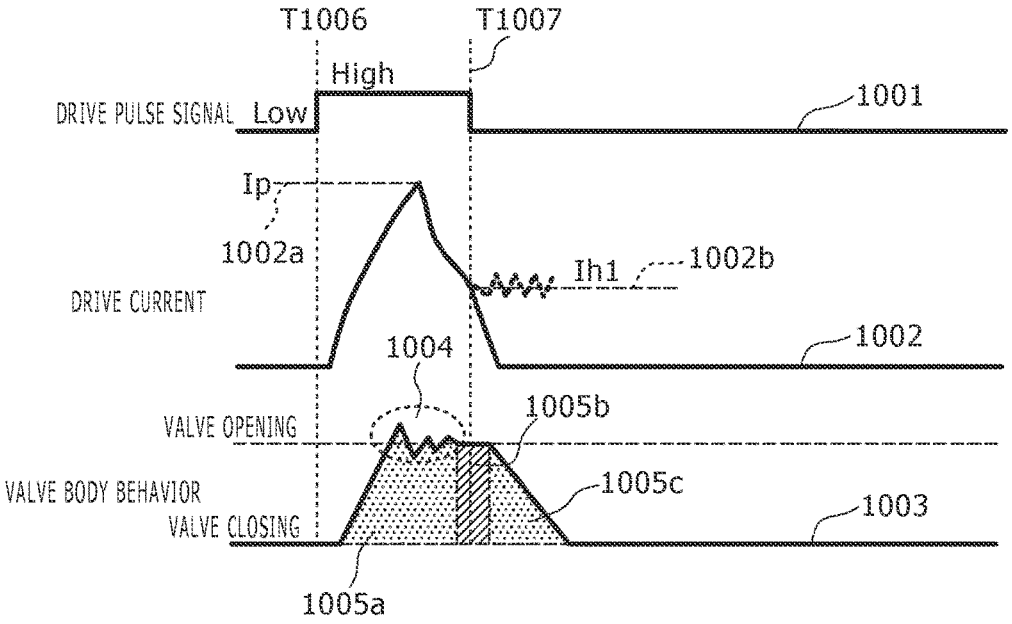
FIG. 10 is a timing chart 1 related to a conventional fuel injection valve drive.

Subsequently, the basic control operation of the fuel injection valve 105 will be described with reference to FIG. 10. FIG. 10 illustrates one example showing the drive current when the drive time of the fuel injection valve 105 is relatively short. That is, this means that a time since the fuel injection on valve 105 is opened until the fuel injection valve 105 is closed is short. The basic control operation of the fuel injection valve 105 will be described. The supply of the drive current to the fuel injection valve starts from a time T1006 when a drive pulse signal 1001 changes from low to high. In this situation, the target control value is so determined as to obtain a desired drive current profile. In this figure, the control is conducted according to whether the real drive current reaches the target control value, or not.

In detail, first, the current Ip (1002*a*) required to open the valve body installed within the fuel injection valve is set as a target current, and on the basis of the above operation, the drive current 1002 is supplied to the fuel injection valve 105. As a result, when the drive current 1002 gradually increases, and soon reaches Ip (1002*a*), the target current is switched to the lh1 (403*b*), and control is made so that the drive current 1002 is attenuated to this value. In the configuration of this figure, because the drive pulse signal 1001 changes from high to low before a drive current 1002 reaches lh1 (1002*b*), a current supply to the fuel injection valve 105 from T1007 stops.

This figure illustrates a case in which the drive time of the fuel injection valve 105 is relatively short. The original drive current 1002 is to be controlled to obtain a profile represented in FIG. 8. However, because the drive time of the fuel injection valve 105 is short, the operation of the fuel injection valve 105 stops without the use of the subsequent target control values (lh1 (805) and Lh2 (806). From this fact, the drive time of the fuel injection valve 105 is relatively short. Hence, it is needless to say that if the drive pulse signal 1002 is longer than that in this figure, even if the drive current reaches Ih1 (1002*b*), the control is executed according to a given target control value (Ih2 (806)).

Subsequently, the valve body behavior provided within the fuel injection valve according to this control will be described. A valve body behavior 1003 is roughly classified into three states including starting valve opening operation 1005*a* on the basis of a drive current 1002 from T1006, thereafter a valve open holding state 1005*b*, and valve closing operation 1005*c* from T1007 when the supply of the drive current stops.

If the drive pulse signal 1001 is relatively long, a period of the valve open holding state 1005*b*, but the valve opening operation 1005*a* and the valve open holding state 1005*b* are hardly changed. Therefore, since the amount of fuel injection injected from the fuel injection valve 105 is governed by a temporal length of the valve opening holding state, the amount of fuel injection is hardly affected by the valve opening operation 1005*a* and 1005*c* of the valve body. However, as with this configuration, if the drive pulse signal 1001 is shorter, the period 1005*b* during which the valve body is completely opened is short, a rate of the periods 1005*a* and 1005*c* during which the valve body is opened or closed is large. For that reason, the amount of fuel injection is extremely largely affected by the opening and closing behaviors (1005*a*, 1005*c*) of the valve body.

Also, the valve opening and closing behaviors (1005*a*, 1005*c*) are different every time the fuel injection valve 105 is driven due to the variation of the drive current 1002. As a typical example, as illustrated in reference numeral 1004 in the figure, there is a bouncing that becomes unstable in the valve behavior by allowing the valve body to vigorously collide with a stopper in opening the valve body, and there arises a problem that the amount of fuel injection is different depending on the presence/absence of the bouncing, or the degree of bouncing. From the above facts, if the drive pulse signal 1001 is shorter, there is required that the fuel injection valve 105 is controlled with high precision, and the valve opening/closing behaviors (1005*a*, 1005*c*) of the valve body are stabilized every times.

Figure 11:
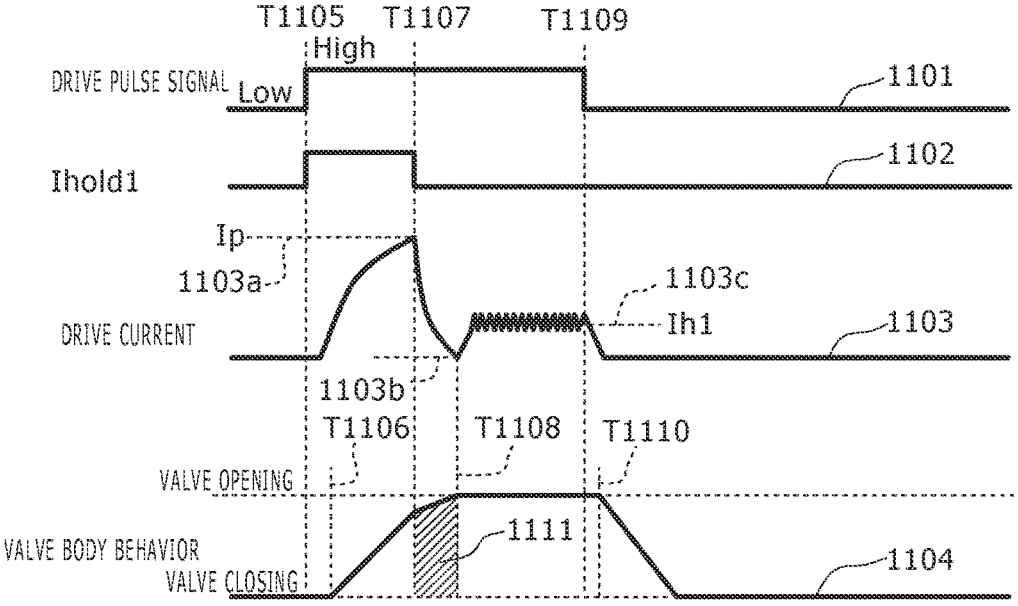
FIG. 11 is a timing chart 2 related to the conventional fuel injection valve drive.

Subsequently, a description will be given of a method of driving the fuel injection valve 105 which reduces the bouncing described above with reference to FIG. 11. In FIG. 11, a current switching signal Ihold1 (1102) is added to a drive pulse signal 1101. The drive pulse signal 1101 is a signal described above, and the Ihold1 (1102) is a signal generated on the basis of the calculation result calculated by the fuel injection valve drive waveform command block 204*b* in FIG. 2. In the case of high level, the supply voltage to be applied to the fuel injection valve 105 is set as the high voltage generated by the high voltage generator circuit 201, and in the case of low level, the supply voltage is set as the low voltage (battery voltage).

For convenience of description, in this drawing, a configuration in which the Ihold1 (1102) is output directly to the fuel injection valve drive IC (203 in FIG. 2) from the drive control unit (204 in FIG. 2) will be described. The problem and advantages of the present invention are not limited to the above configuration, but likewise applied to, for example, a configuration in which information is transmitted on an annual basis by a serial communication when information related to the drive waveform calculated in the block 204*b* in FIG. 2 is output to the fuel injection valve drive IC 203.

A drive control method for the fuel injection valve 105 illustrated in FIG. 11 will be described. A drive current 1103 is supplied to the fuel injection valve 105 from a time (T1105) when both of the drive pulse signal 1101 and the above-mentioned Ihold1 (1102) become high, on the basis of the drive pulse signal 1101 and the Ihold1 (1102). With this operation, the drive current 1103 starts to gradually increase from T1106 when a given period is elapsed from T1105, and reaches Ip (1103*a*) (T1107).

In this situation, the fuel injection valve control device 200 switches the Ihold1 (1102) from high to low, and cuts off the supply of the drive current 1103 while stopping the supply of the high voltage. For that reason, the drive current 1103 is decreased to a desired current (1103*b*). In this configuration, the desired current 1103*b* needs to be optimized according to the valve body characteristic or a fuel pressure of the fuel injection valve 105, but for description, OA is assumed. Also, the desired current 1103*b* may be controlled according to an elapsed time from a T1107 that reaches Ip (1003*a*).

When the drive current 1103 reaches the desired current 1103*b*, the fuel injection valve control device 200 switches a next target control value to the Ih1 (1103*c*), and again starts the supply of the drive current 1103 to the fuel injection valve 105 (T1108). As a result, the drive current 1103 increases to the vicinity of Ih1 (1103*b*) of the target current, and holds Ih1 till T1109 when the drive pulse signal changes from high to low.

In the description of FIG. 11, a series of description has been made with the target control value as the drive current. Alternatively, the target control value may be set as the drive time. For example, a time from T1105 when the drive current is supplied to the fuel injection valve 105 till T1107 after a given time is elapsed from T1105 may be dealt with as the target control value, the drive current 1102 may be cut off, and Ip (1103*a*) may be used instead. It is needless to say that in this method, Ih1 (1103*c*) is also replaced as the drive time from T1108 to T1109.

Subsequently, a description will be given of the valve body behavior provided in the fuel injection valve according to the method of driving the fuel injection valve 105. In the opening behavior of the valve body, the drive current 1103 is supplied from a time (T1105) when the drive pulse signal 1101 becomes high, and the valve opening operation gradually starts after a given time is elapsed (T1106). Thereafter, since the Ihold1 (1102) becomes high, the drive current 1103 continues to be supplied to the fuel injection valve 105 by the above-mentioned high voltage. Therefore, the valve body moves in the valve opening direction while being accelerated.

Thereafter, since the Ihold1 (1102) becomes low, and the supply of the drive current 1103 to the fuel injection valve 105 stops at T1107 when the drive current reaches Ip (1103*a*), the valve opening operation is conducted by only an inertial force. Therefore, the acceleration of the valve body is reduced (1111) into a soft ending state. As a result, the valve body is suppressed to vigorously collide with the stopper, and secondary injection associated with bouncing can be suppressed.

Thereafter, the valve body is completed opened from a soft landing behavior (T1108), and this state is held till T1109 when the drive pulse signal 1101 changes from high to low. Thereafter the drive pulse signal 1101 becomes low at T1109, and the supply of the drive current 1103 stops, and therefore the valve opening behavior is performed at T1110 as a start point.

When the control according to this embodiment is conducted, as compared with the conventional control (control where the multi-stage injection is not conducted), there is a need to drive the fuel injection valve 105 with high precision. In detail, when the soft landing is performed, there is a need to reduce the variation of the valve body behavior caused by at least disturbance.

Specifically, the device difference variation in the high voltage generator circuit 201, and the drive circuits 202*a*, and 202*b* in FIG. 2, or the shunt resistor 309 provided to detect the drive current of the fuel injection valve 105 in FIG. 3 corresponds to the disturbance. That is, when those device difference variation occurs, a profile (a variation in she real drive current to she target current) is largely affected by the device difference variation, and due to this influence, the valve body behavior of the fuel injection valve 105 is also varied. For that reason, it is desirable to detect those device difference variations, and reflect the variations to the target control value of the drive current 1103. For that reason, in the present invention, a variety of correction means described in FIGS. 4 to 9 is provided.

Figure 12:
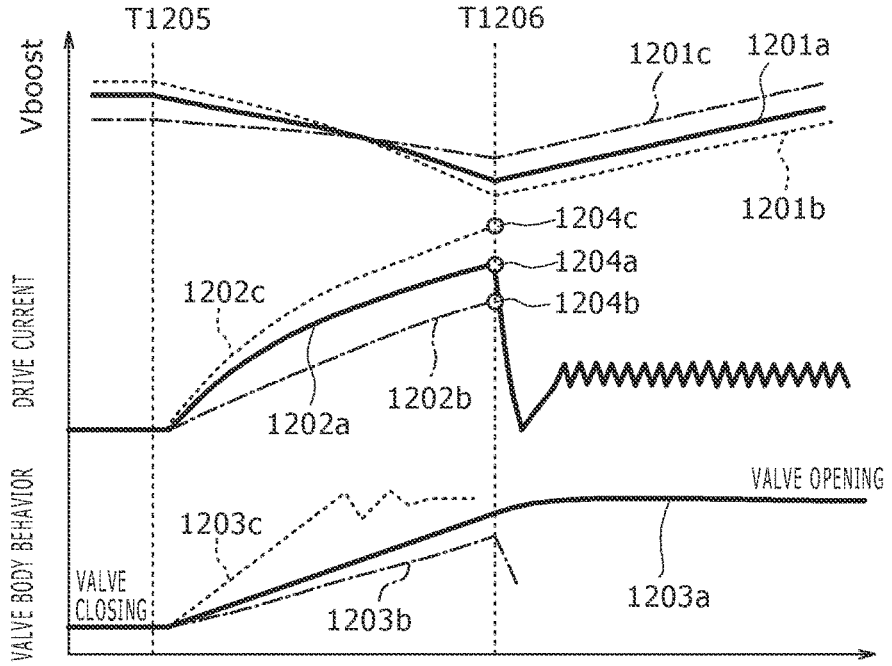
FIG. 12 is a timing chart 3 related to the conventional fuel injection valve drive.

The advantages obtained by correction of the high voltage according to the present invention will be described with reference to FIGS. 12 to 15. FIG. 12 illustrates one example of a timing chart when the target control value of the fuel injection valve 105 is set as the drive time. From above in the figure, Vboost (1201*a*, 1201*b*, 1201*c*), drive currents (1202*a*, 1202*b*, 1202*c*) of the fuel injection valve 105, and the valve body behaviors (1203*a*, 1203*b*, 1203*c*) provided in the fuel injection valve are illustrated. Alphabets attached to the respective ends thereof represent results of driving the fuel injection valve 105 in the different ECUs 100 (fuel injection valve control devices 200).

For convenience of description, it is assumed that the behaviors when the fuel injection valve 105 is driven by the ECU 100 having the high voltage generator circuit 201 with the standard (no variation) boost characteristics are 1201*a* (Vboost), 1202*a* (drive current), and 1203*a* (valve body behaviors).

First, the respective Vboost (120*a*, 1201*b*, 1201*c*) before a time (T1205) when the drive of the fuel injection valve 105 starts represent difference voltages, and it is found that the variation occurs. This is attributable to the differences of the boost characteristics of the high voltage generator circuit 201 described with reference to FIG. 5, or an influence caused by the above-mentioned injection intervals.

Thereafter, in order that the drive of the fuel injection valve 105 starts from T1205, the respective Vboost (1201*a*, 1201*b*, 1201*c*) start to drop. Because the drive currents (1202*a*, 1202*b*, 1202*c*) are determined according to the Vboost (1201, 1201*b*, 1201*c*) at the time T1205, the drive currents start to increase with respective different current profiles, and on the basis of those profiles, descending behaviors of the Vboost (1201*a*, 1201*b*, 1201*c*) are also varied.

Also, because this control has a sequence of stopping the drive currents (1202*a*, 1202*b*, 1202*c*) of the fuel injection valve 105 at T1206 when a given time is elapsed with T1205 as a start point once, the respective drive currents (1204*a*, 1204*b*, 1204*c*) at the time T1206 are different in value from each other.

In an ideal valve body behavior (1203*a*), because the drive current is cut off at an appropriate timing, soft landing can be performed. However, in the 1202*b* having the characteristic of the drive current lower than the ideal drive current (1202*a*), because the current is cut off before the valve body collides with the stopper, there is a risk that the valve body cannot be completely opened as in 1203*b*.

On the other hand, in the 1202*c* having the characteristics of the drive current higher than the ideal drive current (1202*a*), because of a timing when the drive current (1202*c*) is cut off after the valve body has already collided with the stopper, bouncing is conducted as illustrated by 1203*c*, and the advantages of the soft landing cannot be obtained. In this way, if the soft landing cannot be implemented at an appropriate timing, the advantages cannot be obtained. As a result, there is a need to correct a drive condition for converging the variation of the Vboost (1201*a*, 1201*h*, 1201*c*).

Figure 13:
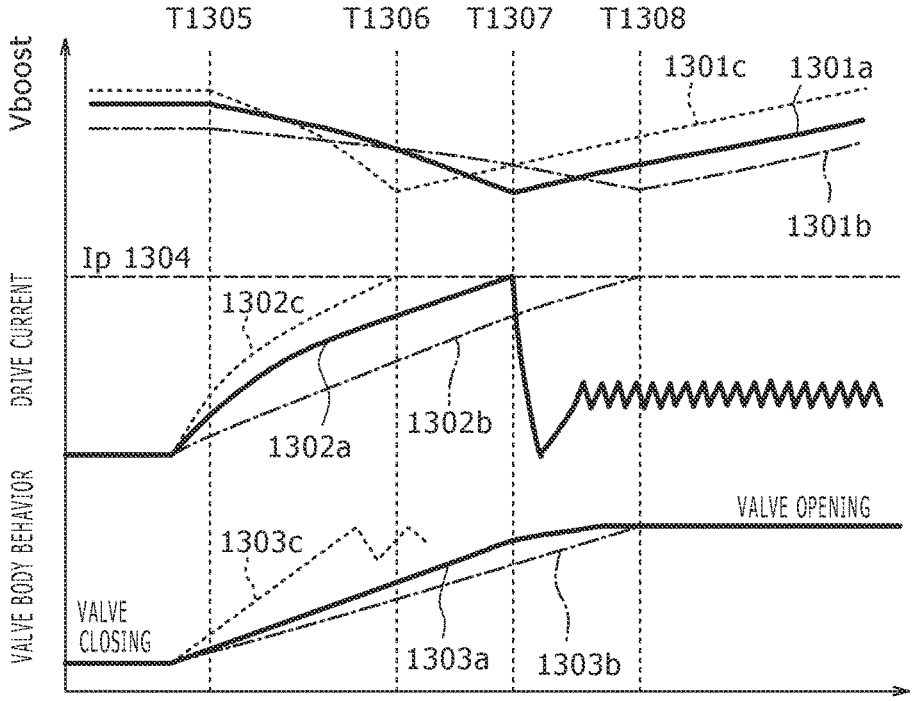
FIG. 13 is a timing chart 4 related to the conventional fuel injection valve drive.

Subsequently, a case in which the target control value of the fuel injection valve 105 is set as the drive current will be described with reference to FIG. 13. In FIG. 13, it is assumed that the drive of the fuel injection valve 105 is also implemented by the respective ECUs 100 (fuel injection valve control devices 200) having the device difference variation of the high voltage generator circuit 201 in FIG. 2, and the respective behaviors caused by the ECU 100 provided with the high voltage generator circuit 201 having the ideal boost characteristics are set as 1301*a* (Vboost), 1302*a* (drive current), and 1303*a* (valve body behavior).

First, before a time (T1305) when the drive of the fuel injection valve 105 starts (T1305), Vboost (1301*a*, 1301*b*, 1301*c*) represent respective different voltages due to the device difference variation of the high voltage generator circuit 201 in FIG. 2, and it is found that the variation occurs. Thereafter, the drive current is supplied to the fuel injection valve 105 until drive currents (1302*a*, 1302*b*, 1302*c*) become Ip (1304). However, the drive current profiles are different (1302*a*, 1302*b*, 1302*c*) according to the supply Vboost (1301*a*, 1301*b*, 1301*c*) depending on the device difference variation of the above-described high voltage generator circuit 201.

For example, the drive current (1302*b*) in the ECU 100 of the Vboost (1301*b*) lower than the Vboost (1301*a*, 1301*b*, 1301*c*) of the ECU 100 having the ideal boost characteristic is gentler in the rising of the drive drive current (1302*c*) in the ECU 100 of the Vboost (1301*c*) higher than the Vboost (1301*a*) of the ECU 100 having the ideal boost characteristic is quicker in the rising than the ideal drive current (1302*a*). For that reason, the valve body behaviors within the fuel injection valve are also affected, and different as indicated by 1303*a*, 1303*b*, and 1303*c*.

As a result, the original valve body behavior is to cut off the current immediately before the valve body collides with the stopper as indicated by 1303*a*, but in the 1303*b* lower in the drive current, a response of the valve body is slow. On the other hand, because 1303*c* is higher in the drive current, the valve body collides with the stopper before reaching Ip (1304), and bouncing occurs. Because the soft landing is performed as described above, even if the stop condition of the drive current is set as Ip (1304), or the drive time (from T1305 to T1308), because the ideal valve body behavior is varied, there is a need to correct the variation.

Also, it is needless to say that the condition of again supplying the drive current to the fuel injection valve 105 also suffers from the same problem in both of FIGS. 2 and 3. That is, when the soft landing of the fuel injection valve 105 is conducted, there is a need to correct the target control value according to the device difference variation of the ECU 100.

Figure 14:
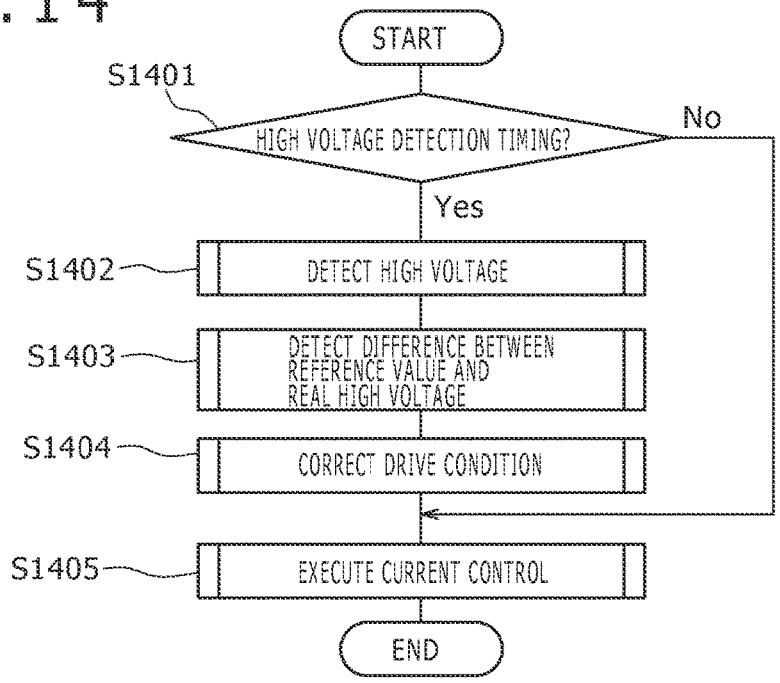
FIG. 14 is a flowchart related to a high voltage variation correction according to the present invention.

Under the circumstances, the present invention is characterized in that the target control value (target current or target drive time) is corrected on the basis of those variations. An embodiment of the present invention will be described with reference to FIGS. 14 and 15. FIG. 14 is a flowchart of the fuel injection valve control device 200 according to the present invention.

In order to solve the above problem, it is first determined whether it is a timing for determining the high voltage, or not, in S1401. In this embodiment, it is assumed what the determination is conducted by an annual processing, and this condition is determined every 10 ms. (Really, it is desirable that the determination is performed just before the drive start timing of the fuel injection valve 105.) If the condition in S1401 is not met, the flow proceeds to Step of S1405. If the condition is met, the flow proceeds to S1402, and the real high voltage is detected by the high voltage detection means 402 in FIG. 4. The real high voltage means the real high voltage really detected as compared with the target high voltage to be generated by the high voltage generation unit.

In S1403, a difference between the real high voltage (real high voltage) detected in S1402 and the reference value (in this example, the target high voltage) of the high voltage is detected. This step corresponds to the contents described in FIGS. 5 and 6. Thereafter, in S1404, the target control value (target current or the target drive time) of the fuel injection valve 105 is corrected according to the difference calculated in S1403. For example, if the target control value is set as the drive current as in FIG. 13, a relation of the voltage and the resistance may be used as an expression from the resistor of the fuel injection valve 105 to correct the current value. After the current correction amount for each of the differences is set in advance, the correction value may be referred to. Further, in the embodiment of FIG. 12, the advantages of the present invention can be obtained by applying the latter for correction. Therefore, in S1405, the drive of the fuel injection valve 105 is implemented, and the current control is executed, which corresponds to the contents described in the fuel injection valve drive means 411 in FIG. 4.

Figure 15:
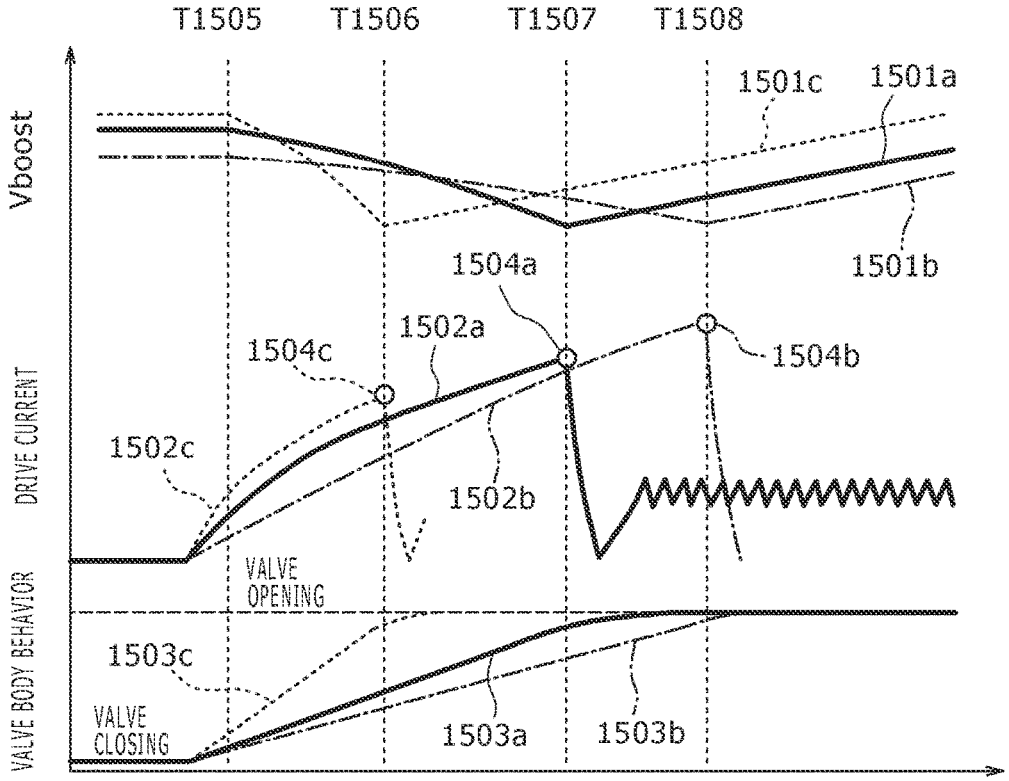
FIG. 15 is a timing chart related to the drive of the fuel injection valve according to the present invention.

The above control will be described with reference to a timing chart of FIG. 15. In this drawings, it is assumed that the respective behaviors when the ECU 100 having the ideal characteristic without the need of correcting the target control value are 1501*a* (Vboost), 1502*a* (drive current), and 1503*a* (valve body behavior).

It is determined whether a condition of S1401 in FIG. 14 is met, or not, before the fuel injection valve 105 is driven (before T1505). If the condition is met, values of the Vboost (1501*a*, 1501*b*, 1501*c*) are detected according to a step S1402, and the flow proceeds to a difference detection step of S1403. In S1403, a difference between the Vboost (1501*a*) of the reference voltage (target high voltage in this example), and 1501*b* or 1501*c* is detected, and the target control value (target current or target drive time) is corrected on the basis of the difference in S1404.

As a result, for example, if the target control value is the drive current, Ip that is a first target control value becomes 1504*a* ideally (when no correction is required). If the real drive current is lower than 1504*a* as the above correction, the drive current is corrected to be higher to increase the drive current (1504*b*). If the real drive current is higher than 1504*a*, the drive current is corrected to be lower to decrease the drive current, to thereby provide 1504*c*.

Also, even if the target control value is the drive time, the first target drive time is T1507 ideally (if no correction is required). The shortage of the drive time, or the extension of the drive time is corrected by the above correction, to thereby provide T1506 (reduction correction of the drive time) or T1508 (extension correction of the drive time). As a result, the behavior when the valve body of the fuel injection valve 105 is opened which is attributable to the device difference variation such as the drive circuit of the fuel injection valve 105 is stabilized, thereby being capable of reducing the variation in the amount of fuel injection of the fuel injection valve 105.

Also, it is needless to say that if the drive current in FIGS. 7 and 8 is corrected at the same time, the fuel injection value is controlled with higher precision. As a result, the valve body behaviors also conduct the soft landing at an ideal timing, the bouncing can be reduced, and the fuel injection control suppressing the variation in the amount of fuel injection can be conducted.

In conducting the soft landing, since a target control value when the drive current is again supplied to the fuel injection valve 105 also requires the above correction, a control corresponding to this correction is performed. With those corrections, the target control values of the drive currents (1504*a*, 1504*b*, 1504*c*) or the drive times (T1506, T1507, T1508) are made variable for each of the ECUs 100, thereby stabilizing the opening behavior of the fuel injection valve 105, and improving the linearity of a low flow rate range.

The embodiments of the present invention have been described in detail above. However, the present invention is not limited to the above embodiments, but can be variously changed in design without departing from the spirit of the present invention described in the patent claims. For example, in the above-mentioned embodiments, in order to easily understand the present invention, the specific configurations are described. However, the present invention does not always provide all of the configurations described above. Also, a part of one configuration example can be replaced with another configuration example, and the configuration of one embodiment can be added with the configuration of another embodiment. Also, in a part of the respective configuration examples, another configuration can be added, deleted, or replaced.

Also, the control lines and the information lines necessary for description are illustrated, and all of the control lines and the information lines necessary for products are not illustrated. In fact, it may be conceivable that most of the configurations are connected to each other. In the above embodiments, the example in which both of the target control value (drive current or drive time) to the fuel injection valve 105 on the basis of at least one result of the high voltage difference detection means 404 and the drive current difference storage means 406 has been described, but only one of them may be corrected.

LIST OF REFERENCE SIGNS

100 . . . ECU
101 . . . internal combustion engine
105 . . . fuel injection valve
200 . . . control device (fuel injection valve control device)
201 . . . high voltage generator circuit (high voltage generation means)
400 . . . control unit
402 . . . high voltage detection means
403 . . . reference voltage
404 . . . high voltage difference detection means
405 . . . current difference value
406 . . . drive current difference storage means
408 . . . drive current detection means
409 . . . drive control value correction means
411 . . . fuel injection valve drive means
1501*a* . . . high voltage behavior by ECU of reference characteristics
1501*b* . . . high voltage behavior corrected by drive time extension or drive current increase of target control value
1501*c* . . . high voltage behavior corrected by drive time reduction or drive current decrease of target control value
1502*a* . . . fuel injection valve drive current by ECU of reference characteristics
1502*b* . . . fuel injection valve drive current corrected by drive time extension or drive current increase of target control value
1502*c* . . . fuel injection valve drive current corrected by drive time reduction or drive current decrease of target control value
1503*a* . . . valve body behavior by ECU of reference characteristics
1503*b* . . . valve body behavior corrected by drive time extension or drive current increase of target control value
1503*c* . . . valve body behavior corrected by drive time reduction or drive current decrease of target control value
1504*b* . . . target control value (current) corrected by drive time extension or drive current increase of target control value
1504*c* . . . target control value (current) corrected by drive time reduction or drive current decrease of target control value
T1505 . . . fuel injection valve drive start timing
T1506 . . . target control value (drive time) corrected by drive time reduction or drive current decrease of target control value
T1507 . . . target control value (drive time) by ECU of reference characteristics
T1508 . . . target control value (drive time) corrected by drive time extension or drive current increase of target control value

The invention claimed is:

1. A control device for an internal combustion engine, comprising:

a battery that applies a battery voltage to the internal combustion engine;

a fuel injection valve that injects a fuel directly into a combustion chamber;

high voltage generation means for boosting the battery voltage to a target high voltage to generate a desired high voltage;

high voltage detection means for detecting a real high voltage generated by the high voltage generation means;

fuel injection valve drive means for supplying any one of the real high voltage detected by the high voltage detection means and the battery voltage to the fuel injection valve at a desired timing to drive the fuel injection valve; and drive current detection means for detecting a drive current of the fuel injection valve, wherein the control device includes high voltage difference detection means for obtaining a difference between a predetermined reference voltage and the real high voltage detected by the high voltage detection means, drive current difference storage means for storing the amount of device difference variation of a real drive current detected by the drive current detection means in advance, and drive control value correction means for correcting at least one of a target value of the drive current to the fuel injection valve and a target value of a drive time, on the basis of at least one result of the high voltage difference detection means and the drive current difference storage means, and when the real high voltage is higher than the predetermined reference voltage, the drive control value correction means is configured to correct at least one of: i) the target value of the drive current to the fuel injection valve, and ii) the target value of the drive time.

2. The control device for an internal combustion engine according to claim 1, wherein the high voltage difference detection means detects a difference between a reference voltage and the real high voltage detected by the high voltage detection means with the target high voltage of the high voltage generation means as the reference voltage.

3. The control device for an internal combustion engine according to claim 1, wherein the control device further comprises a second fuel injection valve, the high voltage difference detection means calculates the reference voltage on the basis of a voltage value of high voltage generated by the high voltage generation means at a first time when the supply of the high voltage to the fuel injection valve stops, an inclination of increase of voltage generated by the high voltage generation means when no high voltage is supplied to the fuel injection valve or to the second fuel injection valve, and a predetermined elapsed time between the first time and a second time when the supply of the high voltage to the second fuel injection valve starts, and the high voltage difference detection means detects a difference between the calculated voltage as the reference voltage and the real high voltage detected by the high voltage detection means.

4. The control device for an internal combustion engine according to claim 1, wherein the drive current difference storage means stores in advance a difference between a real drive current of the fuel injection valve drive means at the time of reaching at least one or more target drive currents when driving the fuel injection valve and the drive current detected by the drive current detection means.

5. The control device for an internal combustion engine according to claim 1, wherein the control device decreases a target value of the drive current to the fuel injection valve, or shortens a target value of the drive time thereto if it is detected that the real high voltage is higher than the reference voltage, and increases the target value of the drive current to the fuel injection valve, or lengthens the target value of the drive time thereto if it is detected that the real high voltage is lower than the reference voltage, on the basis of the detection result of the high voltage difference detection means.

6. The control device for an internal combustion engine according to claim 1, wherein the control device decreases a target value of the drive current to the fuel injection valve, or shortens a target value of the drive time thereto if it is detected that the drive current is larger than the target value of the drive current, and increases the target value of the drive current to the fuel injection valve, or lengthens the target value of the drive time thereto if it is detected that the drive current is smaller than the target value of the drive current, on the basis of the amount of device difference variation stored in the drive current difference storage means.

* * * * *